US007131163B1

(12) United States Patent
Sitawan et al.

(10) Patent No.: US 7,131,163 B1
(45) Date of Patent: Nov. 7, 2006

(54) RETORT CLEANING APPARATUS

(75) Inventors: Vutivase Sitawan, Glendale, CA (US); Jesus Iglesias, Glendale, CA (US); Raul Gonzalez, Glendale, CA (US); Agustin Jaime Hernandez, Glendale, CA (US); Ernesto Cano, Glendale, CA (US)

(73) Assignee: Forest Lawn Memorial-Parks, Glendale, CA (US)

( * ) Notice: Subject to any disclaimer, the term of this patent is extended or adjusted under 35 U.S.C. 154(b) by 583 days.

(21) Appl. No.: 10/418,816

(22) Filed: Apr. 21, 2003

(51) Int. Cl.
*B08B 5/02* (2006.01)
*B08B 9/02* (2006.01)
*B08B 9/027* (2006.01)

(52) U.S. Cl. ..... 15/316.1; 15/415.1

(58) Field of Classification Search ..... 15/300.1, 15/301, 312.1, 321.2, 316.1, 345, 346, 405, 15/406; 239/557, 566, 526
See application file for complete search history.

(56) References Cited

U.S. PATENT DOCUMENTS 122,345 A * 1/1872 Watkins ..... 474/123
331,691 A * 12/1885 Duennisch ..... 15/316.1
388,848 A * 9/1888 Duennisch ..... 15/316.1
3,700,174 A * 10/1972 Beck ..... 239/526
5,860,187 A * 1/1999 Flaszynski et al. ..... 15/304
5,944,911 A * 8/1999 Winters et al. ..... 134/37
6,026,538 A * 2/2000 Watanabe ..... 15/304

FOREIGN PATENT DOCUMENTS

JP 7-243383 * 9/1995

* cited by examiner

*Primary Examiner*—Terrence R. Till
(74) *Attorney, Agent, or Firm*—Albert O. Cota

(57) ABSTRACT

A retort cleaning apparatus 10 (RCA 10) comprising a blow-off nozzle (12) having an air inlet port (14) and an orifice (16). An air passage extension tube (22) has an inward coupler (24), and a heat-resistant outward coupler (26) that attaches to the air inlet port (14) on the blow-off nozzle (12). An air hose (42) has an air inlet coupler (44), and an air outlet coupler (46) that attaches to the inward coupler (24) on the air passage extension tube (22). An air compressor (60) has a compressed air fastener (62) that attaches to the air inlet coupler (44) on the air hose (42). The air compressor is equipped with a power switch (64) that controls the operation of an electrical motor (66). When the power switch is closed, power from a power source (80) is applied to the motor (66) which then allows pressurized air to flow through the air hose (42), the air passage extension tube (22), and into and out of the orifice (16) on the blow-off nozzle (12).

17 Claims, 3 Drawing Sheets

RETORT CLEANING APPARATUS

TECHNICAL FIELD

The invention pertains to compressed-air powered cleaning devices, and more particularly, to a compressed air blowgun that is designed to remove cremated remains and residue from a retort.

BACKGROUND ART

Throughout the world, cremation is a widely used method of disposing of human remains, cremation offers benefits that are not available when burying a person, the most important being that loved ones can retain the "ashes" and therefore be close to the departed. In most modern countries there are crematories that are designed and built exclusively for the cremation of humans. A typical crematory will include a plurality of cremation ovens, or retorts as they are known. The number of retorts will depend on the size of the community which is served. A large metropolitan city will have many crematories, with each having a number of retorts, while a smaller city may only require a single crematory with a few retorts.

Regardless of how many or the manufacturer, most retorts function in a similar manner. A deceased body is placed into a "casket", which often is comprised of a cardboard box, and the body or casket are then slid into the retort by way of a front, or main, door. The actual cremation usually lasts approximately 2.5–3 hours. After the cremation has been completed, a crematory attendant will remove the cremated remains, or "ashes" and clean the retort. Depending on the wishes of the family of the deceased, the ashes are either kept by the family, buried or often dispersed into the air at a location that was special to the deceased, such as the ocean.

A typical retort will have a concrete "floor" upon which the body and casket lie during the cremation. There is a problem that occurs, though, during the removal of the remains and the cleaning of the retort. In order to accomplish the removal and cleaning, the crematory attendant will use a brush and/or rake. Unfortunately, after many uses the concrete floor becomes damaged as a result of the repeated movement of the brush or rate. Some crematories do use compressed air to remove a portion of the remains, and this method is effective. If it was possible to use a compressed air device for the majority of the removal process, the damage that is caused by the brush or rake would no longer exist.

A search of the prior art did not disclose any patents that read directly on the claims of the instant invention, however the following U.S. patents are considered related:

| U.S. Pat. No. | INVENTOR | ISSUED |
|---|---|---|
| 5,661,873 | Karet | Sep. 2, 1997 |
| 4,288,886 | Siegler | Sep. 15, 1981 |
| 4,237,576 | Stakes | Dec. 9, 1980 |

The U.S. Pat. No. 5,661,873 disclosed a vacuum system which provides a compact power unit that accepts and passes debris and waste from the pick up tube to the container. The system directs the major portion of exhaust air including entrained dust particles away from the user.

The U.S. Pat. No. 4,288,886 discloses an air broom for suspension from the hand of a user while standing. The broom includes a power unit and an air impeller connected to and supporting an outward-extending hollow wand those weight and leverage are coordinated with that of the power unit and air impeller. The wand is cantilevered with its outward end adjacent the ground. The apparatus is designed to allow a sweeping action and for gathering with a suction action.

The U.S. Pat. No. 4,237,576 discloses a blower device for sweeping light debris and clutter. The device includes a pressurized air supply source in communication with a receptacle. A standing head of pressure is developed in the receptacle which is then discharged through a nozzle in a jet of air at a substantially constant pressure.

For background purposes and as indicative of the art to which the invention is related reference may be made to the remaining cited patents.

| U.S. Pat. No. | INVENTOR | ISSUED |
|---|---|---|
| 6,119,294 | Lai, et al | Sep. 19, 2000 |
| 4,986,347 | Hirth, et al | Jan. 22, 1991 |
| 3,874,310 | Falling | Apr. 1, 1975 |

DISCLOSURE OF THE INVENTION

The invention discloses a retort cleaning apparatus, that comprises in its basic design, a blow-off nozzle having an air inlet port and an air-jet nozzle. The cleaning apparatus also has an air passage extension tube, which comprises an inward coupler, and an outward coupler that attaches to the air inlet port on the air-jet nozzle.

Further, an air hose has an air inlet coupler, and an air outlet coupler that attaches to the inward coupler on the air passage extension tube. An air compressor has a compressed air fastener that attaches to the air inlet coupler on the air hose. The compressor is equipped with a power switch that controls the operation of an electrical motor. When the power switch is closed, power is applied to the motor, which then allows pressurized air to flow through the air hose, the air passage extension tube and into and out of the air-jet nozzle on the air hose.

In view of the above disclosure, the primary object of the invention is to provide a retort cleaning apparatus that utilizes compressed air to quickly, easily and effectively remove cremated remains and residue from a retort.

It is also an object of the invention to provide a retort cleaning apparatus that:

- is easy to operate,
- is relatively maintenance free,
- can be manufactured as a portable apparatus or be permanently attached, and
- is cost effective from both a manufacturer's and a consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
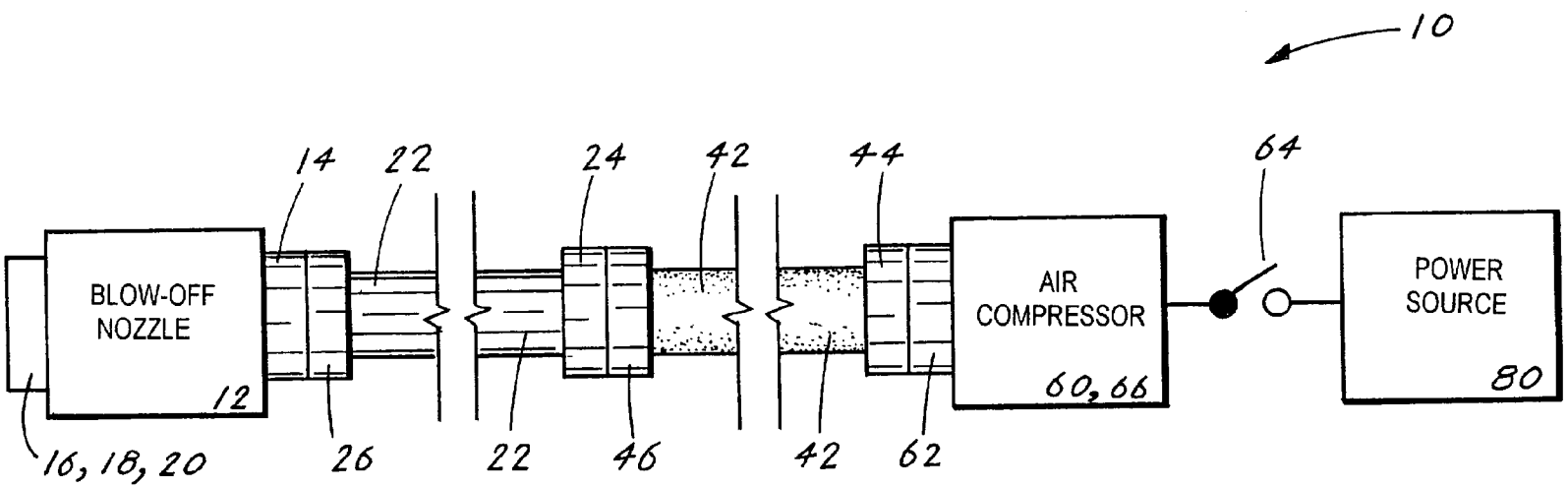
FIG. 1 is a block diagram showing the basic design for the retort cleaning apparatus.

The best mode for carrying out the invention is presented in terms of a preferred embodiment for a retort cleaning apparatus 10 (hereinafter "RCA 10"). The RCA 10 is designed to allow a person to quickly, easily and effectively remove any cremated remains and residue from a retort.

The RCA 10, as shown in FIGS. 1–6, is comprised of the following major elements: a blow-off nozzle 12, an air passage extension tube 22, an air blowgun 30, an air hose 42, an air delivery pipe 50, and an air compressor 60.

Figure 2:
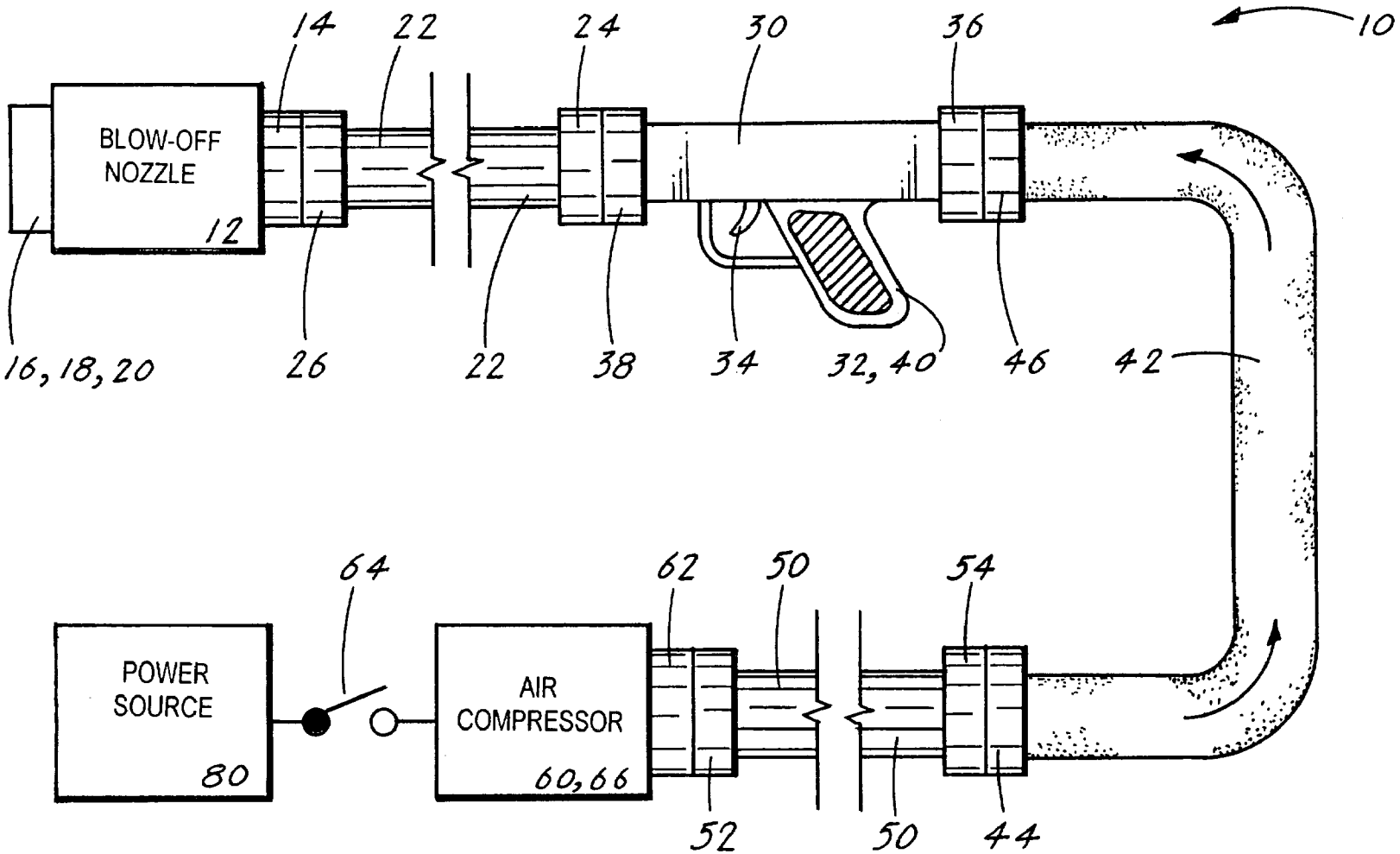
FIG. 2 is a block diagram showing a fully implemented design for the retort cleaning apparatus.
Figure 3:
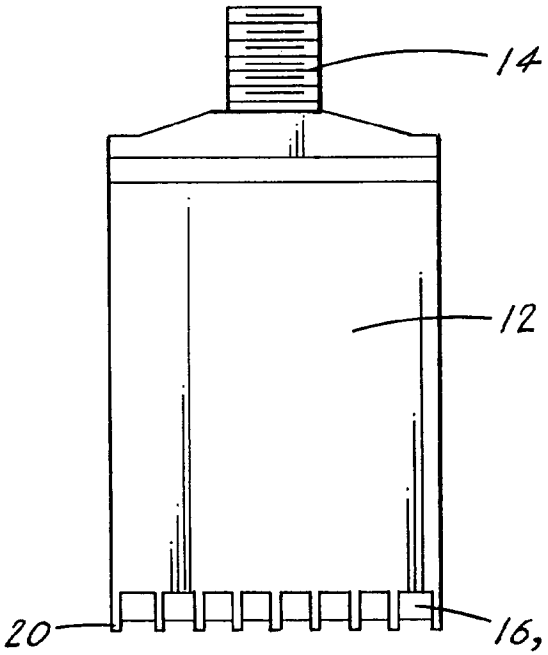
FIG. 3 is a top plan view of a blow-off nozzle.
Figure 4:
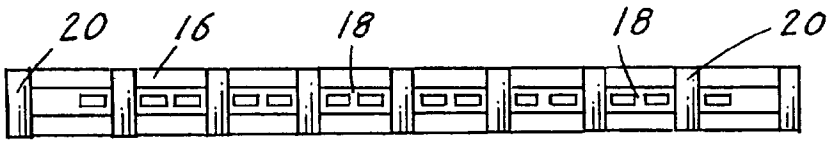
FIG. 4 is an enlarged front elevational view of the blow-off nozzle showing the details of an orifice which includes a plurality of air jet pairs separated by baffles.

The blow-off nozzle 12, as shown attached in FIGS. 1 and 2 and separated in FIGS. 3 and 4, has an air inlet port 14 and a forward orifice 16. The blow-off nozzle 12 is preferably comprised of a jet blow-off nozzle that utilizes an orifice 16 consisting of a plurality of laterally spaced, rectangular air jets 18. Each pair of air jets 18 are separated by an outer-extending baffle 20, as shown in FIGS. 3 and 4. This type of nozzle produces an intense blowing power while reducing the noise level up to 12 db lower than a single, round-hole orifice. The baffles 20 also aid in reducing the noise level and directing the air flow in a forward direction.

The air passage extension tube 22, as shown in FIGS. 1 and 2, has a length ranging between 3-feet (0.91 meters) and 8-feed (2.44 meters) and is preferably constructed of ½" galvanized pipe. The extension tube 22 is comprised of an inward coupler 24, and a heat-resistant, stainless steel, outward coupler 26 that attaches to the air inlet port 14 on the blow-off nozzle 12.

The air blowgun 30, as shown in FIG. 2, is comprised of a handle 32, a trigger 34, an air inlet fastener 36, and an air outlet fastener 38 that attaches to the inward coupler 24 on the air passage extension tube 22. The blowgun handle 32 consists of a pistol grip 40, as shown in FIG. 2, which allows access to the blowgun trigger 34, which is designed to supply a variable air flow control.

The tip of the blowgun is equipped with the air outlet fastener 38, which accepts the corresponding inward coupler 24 on the air passage extension tube 22. The pistol grip 40 can include a protective vinyl grip that prevents slippage and provides a more positive and comfortable hand grip.

The blowgun 30 can also be comprised a button-operated blowgun or a lever-operated blowgun. Likewise, the blow-off nozzle 12 can also be equipped with round or flat nozzle brushes (not shown).

The air hose 42, as shown in FIGS. 1 and 2, is preferably comprised of a recoiling air hose and has an air inlet coupler 44, and an air outlet coupler 46 that attaches to the air inlet fastener 36 on the blowgun 30.

The air delivery pipe 50, as shown in FIG. 2, can be formed of a metal or a hard plastic, such as PVC. The pipe 50 has a pipe inlet fastener 52, and a pipe outlet fastener 54 that attaches to the air inlet coupler 44 on the air hose 42.

The air compressor 60, as shown in FIGS. 1 and 2, has a compressed air fastener 62 that attaches to the pipe inlet fastener 52 on the air delivery pipe 50. The air compressor 60 is a pneumatic system that preferably consists of a 60-gallon tank, a 5 hp, 200 V single-phase motor with an adjustable regulator to control the air pressure from 0 to 120 psi. The compressor 60 also has an electrical power switch 64 that controls the input of electrical power.

The air compressor 60 is preferably comprised of a single-stage air compressor that is preferably driven by a thermal overload-protected electric motor 66, which is operated by a 120-volt a-c utility power. The compressor 60 is equipped with an automatic pressure switch, air gauge, safety valve, shutoff valve and an 8-foot UL approved cord and plug.

When the electrical power switch 64 is closed, the compressed air is applied through the air delivery pipe 50, the air hose 42 and into the air blowgun 30. When the blowgun trigger 34 is depressed, the compressed air flows out of the orifice 16 of the blow-off nozzle 12.

Figure 5:
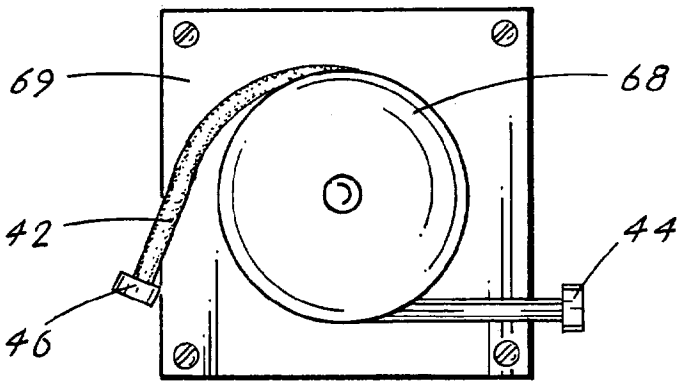
FIG. 5 is a front elevational view of an air hose reel that is permanently attached to a wall.
Figure 6:
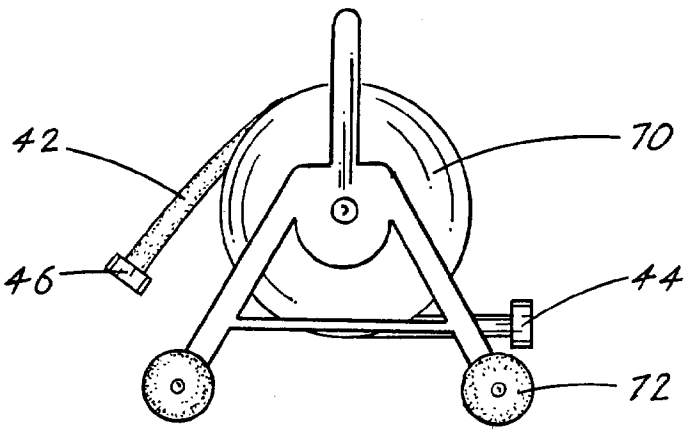
FIG. 6 is a front elevational view of a portable air hose reel.

As shown in FIG. 5, the air hose 42 can be contained within an air hose reel 68 attached to a plate 69 that is permanently mounted on a structure, such as a wall. The reel 68 can also be designed as a portable air hose reel 70 having a set of wheels 72, as shown in FIG. 6.

In order to use the RCA 10, the following steps are performed:

1. slide casket ("case") on charging bier,
2. raise bier as high as it will go,
3. open retort front (main) door and charge "case" feet first into retort,
4. close retort front door,
5. rotate the top dial (labeled "afterburner") clockwise to the "pre-heat" position (red-strip),
6. rotate the bottom dial to the "on" position,
7. wait approximately 2.5–3 hours,
8. when "case" is completed, put on protective helmet, jacket and gloves,
9. open retort front door,
10. use a flat clean-out tool to push the cremated remains toward the rear of the retort,
11. close retort front door,
12. with the front door closed, rake out the large bone fragments (cremated remains) from the rear or side clean-out door (depending on the retort) using the flat clean-out tool,
13. close the clean-out door,
14. open the retort front door and begin the blow back process of the remaining cremated remains and residue. Use the RCA 10 to blow back and clean the retort concrete bed,
15. after the concrete floor has been properly cleaned, close the front door and then proceed to the rear of the retort and clean out the rear door and edge,
16. brush cremated remains into a cooling pan, and
17. inspect the retort with a flashlight to ensure all the cremated remains have been removed and the retort is "clean".

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

The invention claimed is:

1. A retort cleaning apparatus comprising:

a) a blow-off nozzle having an air inlet port and an orifice, comprised of a plurality of laterally spaced, rectangular air jet pairs, b) an air passage extension tube having an inward coupler, and a heat-resistant outward coupler that attaches to the air inlet port on said blow-off nozzle, c) an air hose having an air inlet coupler, and an air outlet coupler that attaches to the inward coupler on said air passage extension tube, and d) an air compressor having a compressed air fastener that attaches to the air inlet coupler on said air hose, wherein said air compressor is equipped with a power switch that controls the operation of an electrical motor, wherein when the power switch is closed, power from a power source is applied to the motor which then allows pressurized air to flow through said air hose, said air passage extension tube and into and out of the orifice of said blow-off nozzle.

2. The apparatus as specified in claim 1 wherein between each pair of air jets is further located an outward-extending baffle.

3. The apparatus as specified in claim 2 further comprising an air blowgun connected in series between said air passage extension tube and said air hose, wherein said air blowgun incorporates a trigger and has an air inlet fastener that attaches to the air outlet coupler on said air hose, and an air outlet fastener that attaches to the inward coupler on said air passage extension tube.

4. The apparatus as specified in claim 3 further comprising an air delivery pipe connected in series between said air hose and said air compressor, wherein said air delivery pipe has a pipe inlet fastener that attaches to the compressed air fastener on said air compressor, and a pipe outlet fastener that attaches to the air inlet coupler on said air hose, wherein when the power switch is closed, the compressed air is applied through said air delivery pipe, said air hose and into said air blowgun, wherein when the blowgun trigger is depressed, the compressed air flows out of the air jet pairs on said blow-off nozzle.

5. The apparatus as specified in claim 4 wherein said air passage extension tube is made of metal or hard plastic and has a length ranging between 3-feet (0.91 meters) and 8-feet (2.44 meters).

6. The apparatus as specified in claim 5 wherein said air hose is contained within a portable air-hose reel.

7. The apparatus as specified in claim 6 wherein said air blowgun further comprises a pistol grip that houses the trigger, wherein the trigger is designed to supply a variable air flow control.

8. A retort cleaning apparatus comprising:

a) a blow-off nozzle having an air inlet port and a forward orifice, b) an air passage extension tube having an inward coupler, and a heat-resistant outward coupler that attaches to the air inlet port on said blow-off nozzle, c) an air blowgun having a handle, a trigger, an air inlet fastener, and an air outlet fastener that attaches to the inward coupler on said air passage extension tube, d) an air hose having an air inlet coupler, and an air outlet coupler that attaches to the air inlet fastener on said air blowgun, e) an air delivery pipe having a pipe inlet fastener, and a pipe outlet fastener that attaches to the air inlet coupler on said air hose, and f) an air compressor having a compressed air fastener that attaches to the pipe inlet fastener on said air delivery pipe, and an electrical power switch that controls the input of electrical power, wherein when the electrical power switch is closed the compressed air is applied through said air delivery pipe, said air hose and into said air blowgun, wherein when the blowgun trigger is depressed, the compressed air flows out of the orifice of said blow-off nozzle.

9. The apparatus as specified in claim 8 wherein said orifice is comprised of a plurality of laterally spaced, rectangular air jet pairs.

10. The apparatus as specified in claim 9 wherein between each pair of air jets is further located an outward-extending baffle.

11. The apparatus as specified in claim 8 wherein said air passage extension tube has a length ranging between 3-feet (0.91 meters) and 8-feet (2.44 meters).

12. The apparatus as specified in claim 11 wherein said blowgun handle consists of a pistol grip that allows access to the blowgun trigger, which is designed to supply a variable air flow control.

13. The apparatus as specified in claim 8 wherein said air hose is contained within an air hose reel that is permanently mounted.

14. The apparatus as specified in claim 8 wherein said air hose is contained within a portable air hose reel.

15. The apparatus as specified in claim 8 wherein said air delivery pipe is formed of a metal.

16. The apparatus as specified in claim 8 wherein said air delivery pipe is formed of a hard plastic.

17. The apparatus as specified in claim 8 wherein said air compressor is comprised of a single stage air compressor that is driven by a thermal-overload-protected electric motor operated by 120 volts a-c utility power.

* * * * *